US010487387B2

(12) United States Patent
Komotori et al.

(10) Patent No.: US 10,487,387 B2
(45) Date of Patent: Nov. 26, 2019

(54) SURFACE NITRIDING TREATMENT METHOD OF TITANIUM MATERIAL

(71) Applicants: KEIO UNIVERSITY, Tokyo (JP); NETUREN CO., LTD., Tokyo (JP)

(72) Inventors: Jun Komotori, Kanagawa (JP); Shumpei Ota, Kanagawa (JP); Kengo Fukazawa, Tokyo (JP); Yoshitaka Misaka, Tokyo (JP); Kazuhiro Kawasaki, Tokyo (JP)

(73) Assignees: KEIO UNIVERSITY, Tokyo (JP); NETUREN CO., LTD., Tokyo (JP)

( * ) Notice: Subject to any disclaimer, the term of this patent is extended or adjusted under 35 U.S.C. 154(b) by 116 days.

(21) Appl. No.: 15/569,988

(22) PCT Filed: Apr. 27, 2016

(86) PCT No.: PCT/JP2016/063250
§ 371 (c)(1),
(2) Date: Oct. 27, 2017

(87) PCT Pub. No.: WO2016/181847
PCT Pub. Date: Nov. 17, 2016

(65) Prior Publication Data

US 2018/0155816 A1 Jun. 7, 2018

(30) Foreign Application Priority Data

May 8, 2015 (JP) ..... 2015-095906

(51) Int. Cl.
*C23C 8/24* (2006.01)
*C23C 8/02* (2006.01)
*C21D 1/06* (2006.01)

(52) U.S. Cl.
CPC ..... *C23C 8/24* (2013.01); *C23C 8/02* (2013.01); *C21D 1/06* (2013.01)

(58) Field of Classification Search
CPC ..... C23C 8/24; C21D 1/06
See application file for complete search history.

(56) References Cited

FOREIGN PATENT DOCUMENTS

| | | | |
|---|---|---|---|
| CN | 103046058 | A | 4/2013 |
| JP | S63-109015 | A | 5/1988 |

(Continued)

OTHER PUBLICATIONS

Sha et al., "X-ray diffraction, optical microscopy, and microhardness studies of gas nitrated titanium alloys and titanium aluminide", Materials Characterization, 59(3): 229-240 (2008).

(Continued)

*Primary Examiner* — Jessee R Roe
(74) *Attorney, Agent, or Firm* — Greenblum & Bernstein, P.L.C.

(57) ABSTRACT

An object of the present invention is to provide, as a simple method, a surface nitriding treatment method of a titanium material, forming a hardened nitrided layer excellent in abrasion resistance on the surface of a titanium material in a shorter time. In order to achieve the object, the present invention adopts a surface nitriding treatment method of a titanium material, wherein a hardened nitrided layer is formed on the surface of the titanium material, by blowing nitrogen gas at a flow rate of 10 L/min or more to the surface of the titanium material while the titanium material is being heated to 800° C. to 1000° C. in an inert gas atmosphere.

12 Claims, 6 Drawing Sheets

(56) References Cited

FOREIGN PATENT DOCUMENTS

| | | | |
|---|---|---|---|
| JP | H06-025825 | A | 2/1994 |
| JP | H06-057401 | A | 3/1994 |
| JP | 2005-068470 | A | 3/2005 |
| JP | 2013-224464 | A | 10/2013 |

OTHER PUBLICATIONS

Office Action issued in KR Application No. 10-2017-7031496, dated Nov. 23, 2018, with English translation.
Extended European Search Report issued in EP Application No. 16 79 2572.6, dated Oct. 30, 2018.
Morita et al., "Effect of Surface-Layer Modification by Nitriding on Fatigue Properties of Pure Titanium", Transactions of the Japanese Society of Medical Engineers,1992, pp. 20-25, vol. 58, No. 546.
International Search Report from Application No. PCT/JP2016/063250, dated Jul. 26, 2016.
International Preliminary Report on Patentability from Application No. PCT/JP2016/063250, dated Nov. 14, 2017.
Office Action issued in CN 201680026872.2, dated Jul. 20, 2018, with English translation.

[Figure 1]
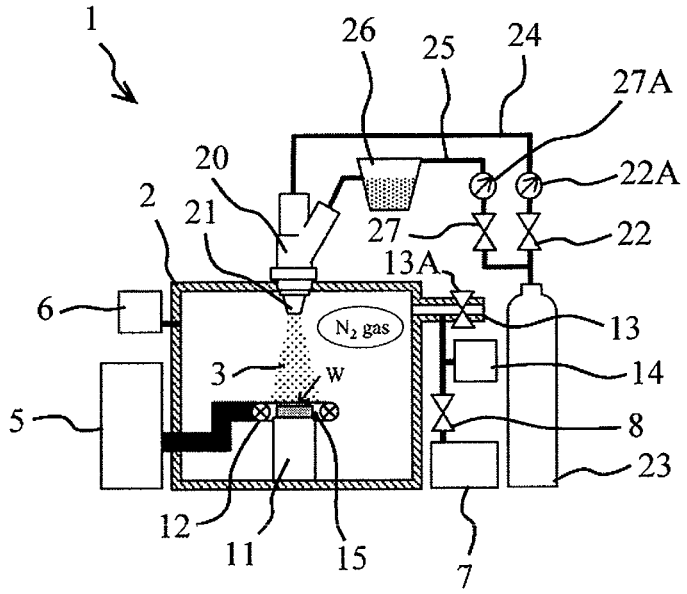
[Figure 2]
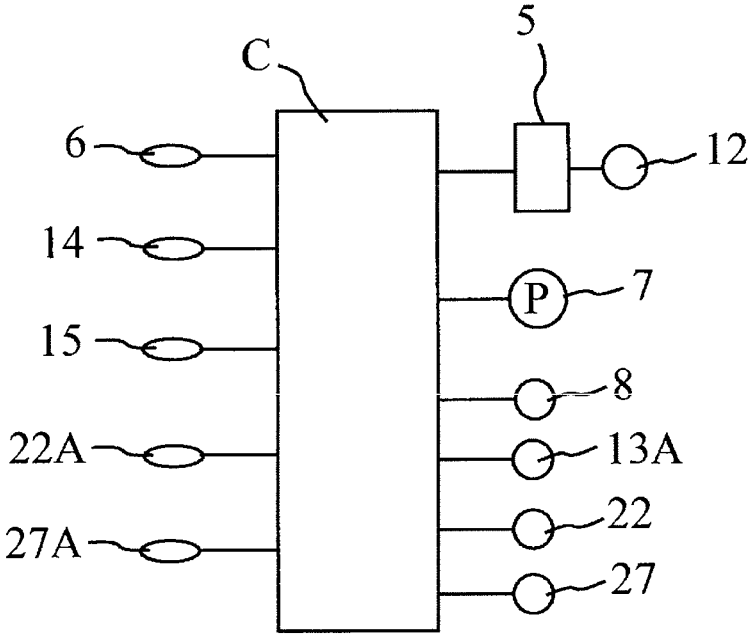

[Figure 3]
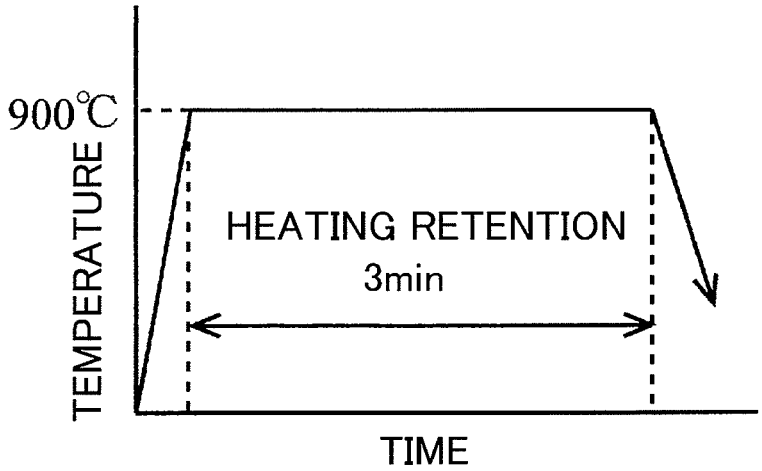
[Figure 4]
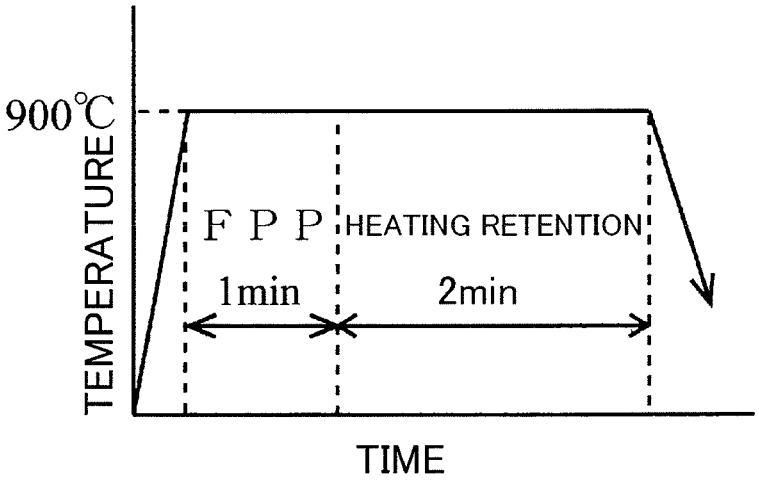

[Figure 5]
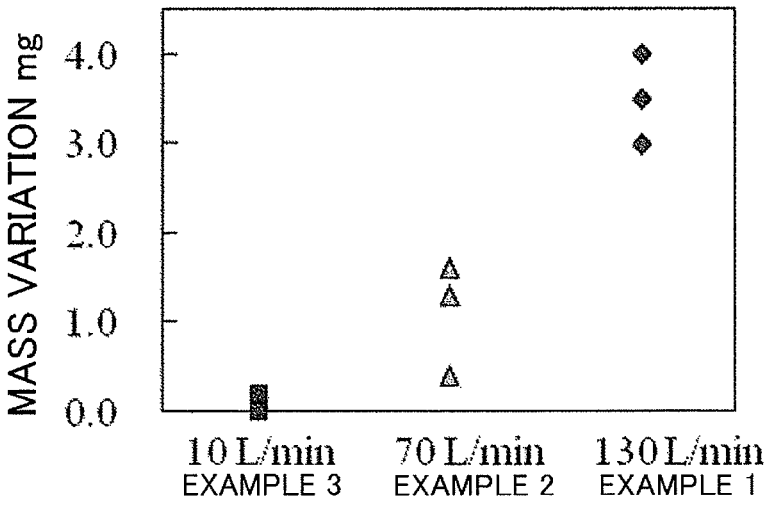
[Figure 6]
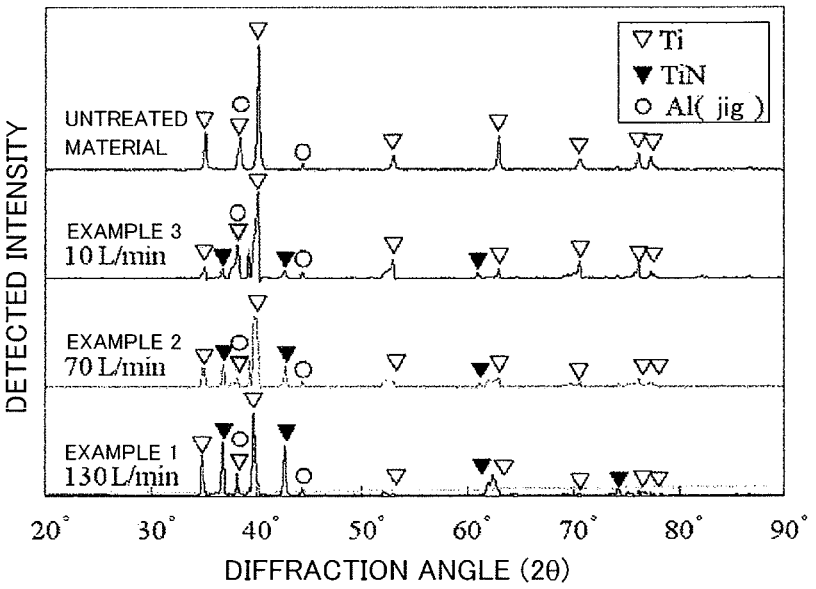

[Figure 7]
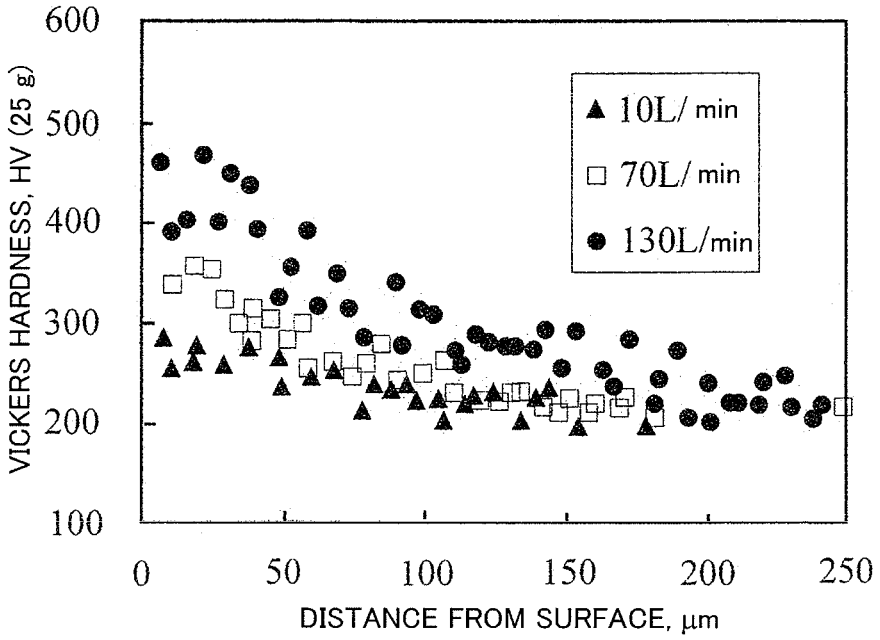

[Figure 8]
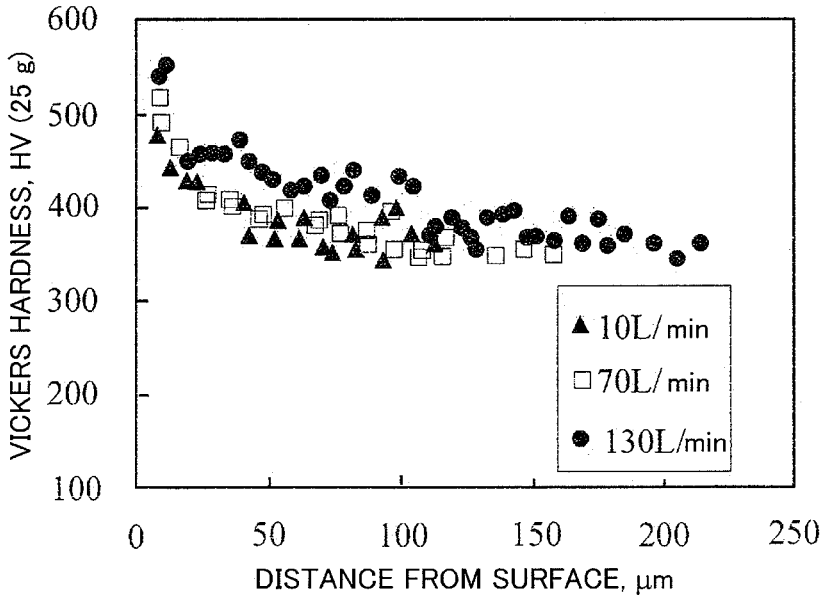
[Figure 9]
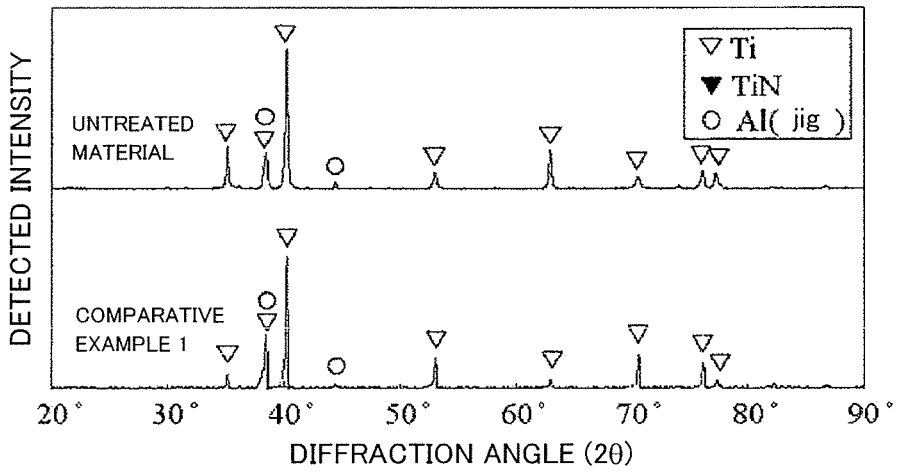

[Figure 10]
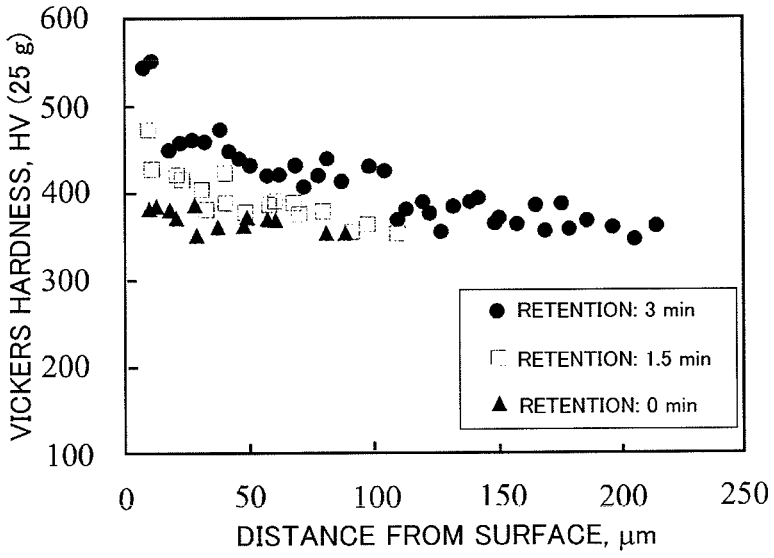
[Figure 11]
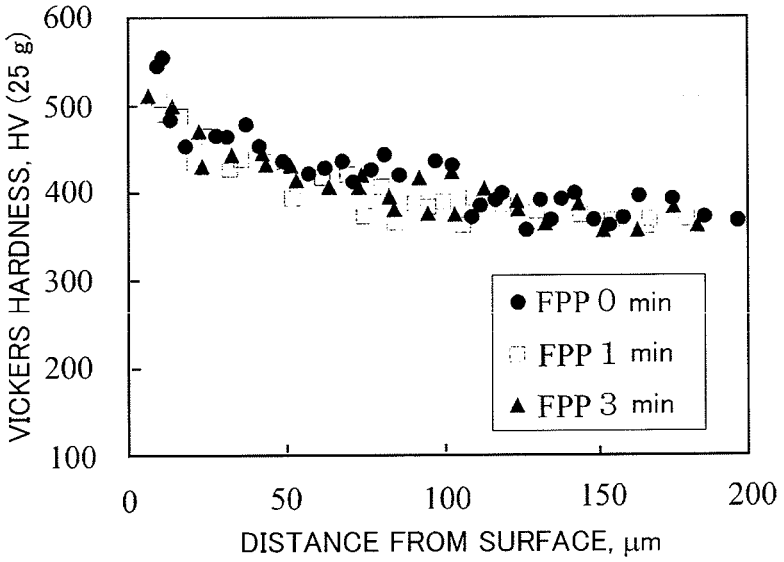

SURFACE NITRIDING TREATMENT METHOD OF TITANIUM MATERIAL

TECHNICAL FIELD

The invention according to the present patent application relates to a nitriding treatment method forming a hardened nitrided layer excellent in abrasion resistance by nitriding treatment on the surface of a titanium material such as pure titanium or a titanium alloy.

BACKGROUND ART

Titanium materials such as pure titanium and titanium alloys have hitherto been used because of being excellent in specific strength, for example, in particular in the fields of aircrafts and vehicle parts requiring weight saving. The titanium material has a high in corrosion resistance and a high biocompatibility, and is used in various forms as constituent materials of biomedical implants.

However, there is a problem that these titanium materials have a low abrasion resistance, and tend to cause seizure; therefore, it has been difficult to use these titanium materials as sliding members. Accordingly, various surface treatment methods for improving the abrasion resistance of the titanium material have been developed. There is a method for forming a hardened nitrided layer on the surface of a titanium material as a hardening treatment method of the surface of a titanium material. As the method for forming a hardened nitrided layer on the titanium material, there have been known, for example, an ion nitriding treatment, a plasma nitriding treatment, and a thermal nitriding treatment.

In the ion nitriding treatment, for example, by using an ion implantation apparatus, in a low-pressure gas containing nitrogen and hydrogen, a glow discharge is generated by applying a direct current voltage of a few hundred volts across a titanium material and a furnace wall, and thus ionized N and NH form a hardened nitrided layer on the surface of the titanium material.

In the plasma nitriding treatment, for example, by using a high-frequency induction plasma generator, a plasma gas of nitrogen and hydrogen is introduced into a plasma torch section, and a titanium material is nitrided in the after-glow region to form a hardened nitrided layer on the surface of the titanium material.

However, the ion nitriding treatment and the plasma nitriding treatment require the use of a special apparatus such as an ion implantation apparatus or a high-frequency induction plasma generator; accordingly, in consideration of the simplicity of the treatment, the formation of a hardened nitrided layer by using the thermal nitriding treatment is effective.

The thermal nitriding treatment forms a hardened nitrided layer on the surface of a titanium material by holding the titanium material in a nitrogen gas at normal pressure and a high temperature for a few hours. For example, Non Patent Literature 1 discloses a technique of forming a hardened nitrided layer on the surface of a titanium material made of pure titanium. In Non Patent Literature 1, an annealed titanium material is hermetically sealed in a vacuum furnace, the vacuum furnace is evacuated to vacuum, the temperature is increased to and retained at a predetermined temperature (880° C.) while nitrogen gas is being allowed to flow at a flow rate of 1 L/min, and thus a nitriding is performed to form a hardened nitrided layer on the surface of the titanium material.

In addition to this, for example, Patent Literature 1 discloses a surface modification method of titanium or a titanium alloy for the purpose of forming a uniform and thick nitrided layer, "wherein titanium or a titanium alloy is heated in a hydrogen atmosphere, and allowed to absorb hydrogen in a content of 0.3 to 1.0 wt %, then heated in vacuum to be dehydrogenated to a hydrogen content of 0.01 wt % or less, thus allowed to have an activated state of the surface, and immediately subsequently subjected to a heating/cooling treatment to form a nitrided layer on the metal surface."

CITATION LIST

Patent Literature

[Patent Literature 1] Japanese Patent Laid-Open No. 06-25825

Non Patent Literature

[Non Patent Literature 1] Tatsuro Morita et al., Effect of Surface-Layer Modification by Nitriding on Fatigue Properties of Pure Titanium, Transaction of the Japanese Society of Mechanical Engineers, A (in Japanese), Vol. 58, No. 546, 1992-2, pp. 20 to 25.

SUMMARY OF INVENTION

Technical Problem

However, the above-described method for forming a hardened nitrided layer of Non Patent Literature 1 requires 25 hours for the annealing of the titanium material at 880° C. and the subsequent nitriding treatment of the titanium material. Also, in Patent Literature 1 forming a nitrided layer after the formation of the activated state of the surface by using hydrogen, the gaseous nitriding treatment requires to maintain the titanium material at 850° C. for 10 hours. The above-described ion nitriding treatment method and the above-described plasma nitriding treatment method using special apparatuses such as an ion implantation apparatus and a high-frequency induction plasma generator also require a treatment time of approximately 0.5 hour to 12 hours at high temperature of 900° C. or higher.

Accordingly, the market has demanded a development of a surface nitriding treatment method capable of forming a hardened nitrided layer on the surface of a titanium material by a simple method and in a shorter time.

Solution to Problem

Accordingly, the present inventors made a diligent study, and consequently has adopted the below-described surface nitriding treatment method according to the present invention.

Specifically, the surface nitriding treatment method of a titanium material, according to the present invention, is a surface nitriding treatment method of performing a nitriding treatment of the surface of a titanium material by using nitrogen gas, wherein a hardened nitrided layer is formed on the surface of the titanium material, by blowing nitrogen gas at a flow rate of 10 L/min or more to the surface of the titanium material while the titanium material is being heated to 800° C. to 1000° C. in an inert gas atmosphere.

In the present invention, the blowing flow rate of the nitrogen gas is preferably 70 L/min or more.

In the present invention, the titanium material is preferably pure titanium or a titanium alloy.

In the present invention, the titanium material is preferably heated by a high-frequency induction heating method.

In the present invention, the heating time of the titanium material involving the blowing of nitrogen gas is preferably 1 minute to 60 minutes.

In the present invention, it is also preferable that the nitrogen gas contain a blasting material, the blasting material be jetted to the surface of the titanium material being heated, and thus the titanium material be subjected to a surface treatment.

In this case, the blasting material is preferably a titanium particle.

Advantageous Effects of Invention

According to the surface nitriding treatment method of a titanium material according to the present invention, a hardened nitrided layer can be formed on the surface of a titanium material in a short time of 1 minute to 60 minutes, by blowing nitrogen gas at a flow rate of 10 L/min or more to the surface of the titanium material, while the titanium material is being heated to 800° C. to 1000° C. in an inert gas atmosphere. Therefore, according to the present invention, it is possible to provide a titanium material having, on the surface thereof, a hardened nitrided layer excellent in abrasion resistance, in a higher production efficiency as compared with conventional methods, by using an existing apparatus, and by altering the flow rate of nitrogen gas.

BRIEF DESCRIPTION OF DRAWINGS

FIG. 1 is a schematic structure diagram of a surface nitriding treatment apparatus implementing the surface nitriding treatment method of the present invention.

FIG. 2 is an electric block diagram of a control device.

FIG. 3 is a graph showing the thermal history of Example 1.

FIG. 4 is a graph showing the thermal history of the specimen of Example 9.

FIG. 5 is a graph showing the mass changes, between before and after the treatment, of Example 1 to Example 3.

FIG. 6 is a chart showing the XRD analysis results of Example 1 to Example 3 and an untreated material.

FIG. 7 is a graph showing the Vickers hardness distributions of Example 1 to Example 3, in the direction from the surface toward the inside on a longitudinal cross section.

FIG. 8 is a graph showing the Vickers hardness distributions of the test specimens of Example 4 to Example 6, in the direction from the surface toward the inside on a longitudinal cross section.

FIG. 9 is a chart showing the XRD analysis results of Comparative Example 1 and an untreated material.

FIG. 10 is a graph showing the Vickers hardness distributions of the test specimens of Example 4, Example 7 and Comparative Example 2, in the direction from the surface toward the inside on a longitudinal cross section.

FIG. 11 is a graph showing the Vickers hardness distributions of the test specimens of Example 4, Example 8 and Example 9, in the direction from the surface toward the inside on a longitudinal cross section.

DESCRIPTION OF EMBODIMENTS

Hereinafter, the embodiments of the surface nitriding treatment method of a titanium material, according to the present invention are described. The surface nitriding treatment method of a titanium material, according to the present invention, is a surface nitriding treatment method of a titanium material, performing a nitriding treatment of the surface of a titanium material by using nitrogen gas, wherein a hardened nitrided layer is formed on the surface of the titanium material, by blowing nitrogen gas at a flow rate of 10 L/min or more to the surface of the titanium material while the titanium material is being heated to 800° C. to 1000° C. in an inert gas atmosphere.

In the present invention, as the titanium material to be an object of the surface nitriding treatment, pure titanium or a titanium alloy can be used. Examples of the titanium alloy include an $\alpha+\beta$-type titanium alloy, an $\alpha$-type titanium alloy, and a $\beta$-type titanium alloy. Examples of the $\alpha+\beta$-type titanium alloy include Ti-6Al-4V, Ti-8Mn, Ti-6Al-6V-2Sn, and Ti-10V-2Fe-3Al. Examples of the $\alpha$-type titanium alloy may include Ti-5Al-2.5Sn. Examples of the $\beta$-type titanium alloy may include Ti-13V-11Cr-3Al, Ti-15Mo-5Zr-3Al, and Ti-15V-3Cr-3Al-3Sn.

In the surface nitriding treatment method of a titanium material in the present invention, the surface nitriding treatment is performed under a controlled atmospheric condition allowing the surface treatment atmosphere of the titanium material to be an inert gas atmosphere. As the inert gas forming the surface treatment atmosphere, a rare gas such as argon may be used; however, in the present invention, it is preferable to use nitrogen gas. This is because as a nitriding treatment, nitrogen gas is used by blowing nitrogen gas to the titanium material.

In the present invention, the method for heating the titanium material is not particularly limited; it is possible to adopt any heating method allowing the titanium material to be the object of the surface nitriding treatment to be heated to 800° C. to 1000° C. Examples of such a method may include a furnace heating method and a high-frequency induction heating method (Induction-Heating: IH). In the present invention, it is more preferable to use the high-frequency induction heating method as a heating method of a titanium material. This is because the high-frequency induction heating method can heat in a short time the titanium material to be an object of the surface nitriding treatment to a high temperature of 800° C. to 1000° C.

In the present invention, the heating temperature of the titanium material to be an object of the surface nitriding treatment is set, as described above, to be 800° C. to 1000° C. When the heating temperature of the titanium material to be an object of the surface nitriding treatment is lower than 800° C., the velocity of the diffusion of nitrogen into the inside of the base material of the titanium material is small, it is difficult to form in 60 minutes or less a hardened nitrided layer having a thickness of 20 μm or more, provided with a hardness required for a product. When the heating temperature of the aforementioned titanium material is higher than 1000° C., unpreferably crystal grains are coarsened and the strength of the titanium material itself is degraded.

In the surface nitriding treatment method of a titanium material of the present invention, nitrogen gas is blown at a flow rate of 10 L/min or more to the surface of a titanium material being heated to 800° C. to 1000° C. in an inert gas atmosphere. The flow rate of the nitrogen gas is more preferably 70 L/min or more, and furthermore preferably 130 L/min or more. In the present invention, only the lower limit of the flow rate of the nitrogen gas blown to the surface of the titanium material is specified. When the flow rate of the nitrogen gas is 10 L/min or more, it is possible to form on the surface of the titanium material in a time as short as 10 minutes a hardened nitrided layer having a thickness of 20 μm or more, provided with a hardness required for a product. In the present invention, the upper limit value of the flow rate of the nitrogen gas blown to the surface of the titanium material is not particularly limited. The larger the flow rate of the nitrogen gas, it is possible to form a hardened nitrided layer having the higher hardness and the larger thickness in a short time. However, in consideration of practicality, the flow rate of the nitrogen gas is preferably set to be 200 L/min or less.

In the present invention, the heating time of the titanium material in heating to a high temperature of 800° C. to 1000° C. in an inert gas atmosphere, involving the blowing of the nitrogen gas at the flow rate of 10 L/min or more, is preferably set to be at least 1 minute or more. When the heating time of the titanium material involving the blowing of the nitrogen gas at a flow rate of 10 L/min or more is less than 1 minute, the thickness of the hardened nitrided layer formed on the surface of the titanium material is insufficient, and it is difficult to secure the hardness required as a product such as a sliding member. In the present invention, the upper limit value of the heating time of the titanium material involving the blowing of the nitrogen gas at a flow rate of 10 L/min or more is set to be 60 minutes. This is because even when the heating time is set to be 60 minutes or more, the increase rates of the thickness and the hardness of the hardened nitrided layer formed on the surface of the titanium material are saturated, and the heating time of 60 minutes is sufficient in consideration of the production efficiency.

A hardened nitrided layer is formed on the surface of the titanium material by the surface nitriding treatment method of a titanium material of the present invention. The hardened nitrided layer includes a TiN layer and a nitrogen diffusion layer. The TiN layer is a layer formed on the outermost surface of the titanium material, by the chemical combination of Ti and $N_2$. The TiN layer is formed on the outermost surface of the titanium material in a thickness of a few microns or less. The nitrogen diffusion layer is a layer formed as a layer lower than the IiN layer, and is a layer formed by the diffusion of nitrogen into the inside of the base material of the titanium material. The nitrogen diffusion layer is formed in a thickness of 20 μm to 100 μm. The hardened nitrided layer having these TiN layer and nitrogen diffusion layer is higher in hardness as compared with the base material of the titanium material, and is excellent in mechanical properties such as abrasion resistance. Accordingly, the titanium material having the hardened nitrided layer formed thereon is improved in abrasion resistance.

In the surface nitriding treatment method of a titanium material of the present invention, the nitrogen gas blown to the surface of the titanium material being heated to the above-described temperature includes a blasting material, and the titanium material is preferably surface-treated by jetting the blasting material (Fine Particle Peening: FPP) to the surface of the titanium material. By allowing the nitrogen gas blown to the surface of the titanium material to include a blasting material, and by allowing the blasting material to collide with the surface of the titanium material, the formation of the nitrogen diffusion layer is promoted while the formation of the TiN layer to be a factor to degrade the fatigue strength is being suppressed, and thus the formation of the hardened nitrided layer provided with a predetermined strength can be performed.

In the present invention, as the blasting material, any blasting material composed of the particles of a chemically stable inorganic substance can be used. Examples of such an inorganic substance include titanium, alumina, a high speed tool steel particle, chromium, nickel, molybdenum, aluminum, iron, and silicon. As a particle not affecting the chemical composition of the surface of the titanium material, it is preferable to use titanium, alumina and a high speed tool steel particle. As the blasting material, a material in which the average particle size is regulated to be a few microns to a few hundred microns can be used. In the present invention, the object of the surface nitriding treatment is a titanium material, and in consideration of the scraping of the hardened nitrided layer on the surface of the titanium material by the collision of the blasting material, it is preferable to use titanium particles, in particular, titanium particles having an average particle size of 45 μm or less.

Next, a surface nitriding treatment apparatus to which the surface nitriding treatment method of the present invention is applied is described with reference to the accompanying drawings. FIG. 1 is a schematic structure diagram of a surface nitriding treatment apparatus 1 to which the surface nitriding treatment method of the present invention is applied. The surface nitriding treatment apparatus 1 in the present embodiment is a vacuum replacement type apparatus having an airtightly formed chamber 2. In the chamber 2, a support 11 placing and holding a titanium material W on the top thereof, and an induction heating coil (heating unit) 12 arranged around the titanium material W placed on the support 11 are arranged; in the chamber 2, there is arranged a discharge unit 20 to jet nitrogen gas 3 or nitrogen gas containing a blasting material against the titanium material W placed on the support 11.

In the chamber 2, a vacuum gauge 6 to detect the pressure inside the chamber 2 and an exhaust path 13 to discharge the gas inside the chamber 2 are provided. In the exhaust path 13, an atmosphere open valve 13A is arranged, and a vacuum pump 7 is arranged at a position upstream of the atmosphere open valve 13A is also arranged. An exhaust valve 8 and a zirconia-type oxygen concentration meter 14 to detect the oxygen concentration in the gas inside the chamber 2 are arranged upstream of the vacuum pump 7. On the support 11, a temperature sensor 15 to detect the surface temperature of the titanium material W placed on the support 11 is arranged. The induction heating coil 12 is connected to a high frequency applying device 5 arranged outside the chamber 2, and a high-frequency current having a predetermined frequency is applied to the induction heating coil 12. The high frequency applying device 5 applies a high frequency current having a single frequency or a plurality of frequencies to the induction heating coil 12 to induction heat the titanium material W.

The discharge unit 20 arranged in the chamber 2 is provided with a discharge nozzle 21 directed to the support 11. To the discharge nozzle 21, a nitrogen gas supply unit 23 to supply nitrogen gas is connected. To the nitrogen gas supply unit 23, a gas supply path 24 directly connected to the discharge nozzle 21, and a blasting material supply path 25 connected to the discharge nozzle 21 through the intermediary of a part feeder 26 housing the blasting material are connected. In the gas supply path 24, a gas regulation valve 22 to regulate the gas supply rate and a gas flow meter 22A are interposed. In the blasting material supply path 25, a blasting material regulation valve 27 to regulate the gas supply rate and a flowmeter 27A are interposed.

In the present invention, the interior of the chamber 2 is only required to be regulated to be in an inert gas atmosphere; accordingly, a rare gas such as argon may be used as an inert gas to form an inert gas atmosphere in the interior of the chamber, and at the time of the nitriding treatment, nitrogen gas may be used as a gas to be blown to the titanium material W. However, in consideration of the simplification of the apparatus, it is preferable to use nitrogen gas as the gas forming the inert gas atmosphere in the chamber 2. The blowing flow rate of nitrogen gas from the discharge nozzle 21 is set to be 10 L/min or more. It is to be noted that the control of the discharge rate of nitrogen gas from the discharge nozzle 21 may be controlled not by the blowing flow rate but by the discharge pressure (for example, 0.1 MPa or more).

FIG. 2 is an electric block diagram of the control device C of the surface nitriding treatment apparatus 1 according to the present embodiment. The control device C is constituted with a general-purpose microcomputer, and a memory recording a control program is built in. To the input side of the control device C, the vacuum gauge 6, the oxygen concentration meter 14, the temperature sensor 15 to detect the surface temperature of the titanium material W, and the flow meters 22A and 27A are connected. To the output side of the control device C, the induction heating coil 12 is connected through the intermediary of the high frequency applying device 5, and the vacuum pump 7, the exhaust valve 8, the gas regulation valve 22, the blasting material regulation valve 27 and the atmosphere open valve 13A are connected.

The control device C, on the basis of the sets of information such as the control program recorded in the built-in memory, the detected degree of vacuum and the detected oxygen concentration inside the chamber, the detected surface temperature of the titanium material W, and the detected flow rate of nitrogen gas, the control of the vacuum pump 7, the high frequency applying device 5, the exhaust valve 8, the atmosphere open valve 13A, the gas regulation valve 22, and the blasting material regulation valve 27 is performed, and thus, the atmosphere inside the chamber 2, and the heating temperature of the titanium material W, the blowing flow rate of nitrogen gas, and the application or the nonapplication of the jet of the blasting material are controlled.

Next, the operation of the surface nitriding treatment apparatus 1 according to the present embodiment is described. In the present embodiment, before the supply of the inert gas, the interior of the chamber 2 is evacuated to vacuum. At the beginning, in the control device C, as a step of evacuation to vacuum, the vacuum pump 7 is driven and the exhaust valve 8 is opened, under the conditions that the atmosphere open valve 13A, the gas regulation valve 22 and the blasting material regulation valve 27 are closed. The vacuum pump 7 is driven until the pressure inside the chamber 2 reaches a predetermined pressure such as 130 Pa or less, and subsequently the exhaust valve 8 is closed to complete the step of evacuation to vacuum. After the completion of the evacuation to vacuum, the control device C moves to a step of supplying an inert gas, and an inert gas such as nitrogen gas is supplied in the chamber 2. Specifically, the control device C opens only the gas regulation valve 22, and supplies nitrogen gas as the inert gas in the chamber 2. The control device C opens the atmosphere open valve 13A after the pressure inside the chamber 2 reaches a pressure equal to or higher than the atmospheric pressure. Thus, only nitrogen gas is jetted into the interior of the chamber 2 from the discharge nozzle 21, the air in the chamber 2 is discharged from the discharge opening 13, and nitrogen gas is filled in the chamber 2. When the oxygen concentration in the chamber 2 detected with the oxygen concentration meter 14 is decreased to a value equal to or less than a predetermined value (for example, 10 ppm or less), the control device C moves to the step of surface nitriding treatment.

In the step of surface nitriding treatment, the control device C regulates the nitrogen gas flow rate to a predetermined value, supplies a high-frequency current from the high frequency applying device 5 to the induction heating coil 12, and heats the titanium material W so as for the surface temperature of the titanium material W to reach a predetermined heat treatment temperature. When nitrogen gas is adopted as the inert gas, in the step of surface nitriding treatment, the gas jetted from the discharge nozzle 21 is altered to nitrogen gas, and nitrogen gas is jetted at a predetermined flow rate. In this case, a high-frequency current is supplied to the induction heating coil 12 in such a way that the surface temperature of the titanium material W is retained at a predetermined heat treatment temperature, specifically, a temperature set at any temperature within the range from 800° C. to 1000° C. by the temperature sensor 15 as described above. The heat treatment of the titanium material W based on the supply of the high-frequency current, involving the blowing of nitrogen gas from the discharge nozzle 21 to the surface of the titanium material W is performed for 1 minute to 60 minutes. By blowing nitrogen gas at a flow rate of 10 L/min or more to the surface of the titanium material W induction-heated in an inert gas atmosphere, a hardened nitrided layer is formed on the surface of the titanium material. Specifically, there are formed, as the hardened nitrided layer, a nitrogen diffusion layer formed by the diffusion of nitrogen from the surface of the titanium material into the inside of the titanium material, and a TiN layer formed by chemical combination of titanium and nitrogen on the outermost surface of the titanium material. In this case, due to the state in which the amount of oxygen in the chamber 2 is extremely small, oxidized scales are little produced on the surface of the titanium material W. The heating time involving the blowing of nitrogen gas is varied according to the required hardness of the surface of the titanium material W and the required thickness of the hardened nitrided layer.

When the blowing of nitrogen gas involved in the heating of the titanium material W is performed, in the case where a shot peening treatment (FPP treatment) is performed by using nitrogen gas containing a blasting material, and by allowing the blasting material collide with the surface of the titanium material W, the gas regulation valve 22 and the blasting material regulation valve 27 are opened and controlled, and the nitrogen gas allowed to contain the blasting material is jetted from the discharge nozzle 21. By opening the blasting material regulation valve 27, the nitrogen gas discharged from the nitrogen gas supply unit 23 flows into the blasting material supply path 25 and is jetted from the discharge nozzle 21 along with the blasting material contained in the part feeder 26. When the blasting material 3 discharged from the discharge nozzle 21 along with the nitrogen gas collides with the surface of the titanium material W being induction-heated in the inert gas atmosphere, the nitrogen diffusion layer due to the diffusion of nitrogen into the inside is formed on the surface of the titanium material W while the formation of the TiN layer is being suppressed.

In the present invention, as described above, the nitrogen gas to be blown to the surface of the titanium material W being heated may be wholly a nitrogen gas not containing the blasting material, or may be wholly a nitrogen gas containing the blasting material; or alternatively, the nitrogen gas containing the blasting material may be used only in part of the treatment time, for example, in a predetermined time at the beginning, and the nitrogen gas not containing the blasting material may be used in the rest of the treatment time. In other words, the heat treatment of the titanium material W involving the blowing of nitrogen gas may involve no FPP treatment, may involve the FPP treatment in the whole treatment step of the heat treatment, or may involve the FPP treatment in part of the heat treatment. The time allocation of the FPP treatment is also not particularly limited herein, and may be changed according to the required hardness and the required thickness of the hardened nitrided layer.

Next, the control device C ceases the supply of the high-frequency current to the induction heating coil 12 from the high frequency applying device 5, blows only nitrogen gas to the titanium material W from the discharge nozzle 21, and performs cooling over a predetermined time, for example, 30 seconds. By passing through the above-described steps, a hardened nitrided layer is formed on the surface of the titanium material W.

EXAMPLES

Next, Example 1 to Example 9 of the surface nitriding treatment method of a titanium material according to the present invention are described.

Example 1

In Example 1, the surface nitriding treatment of a titanium material made of a pure titanium material was performed by using the above-described surface nitriding treatment apparatus 1, without performing the FPP treatment. In Example 1, as a test specimen, an industrial pure titanium rolled round rod (ϕ15 mm, t4 mm) was used. First, the above-described test specimen was placed inside the induction heating coil 12, the interior of the chamber 2 was evacuated to vacuum, then nitrogen gas (purity: 99.99%) was supplied from the discharge nozzle 21, and the atmosphere in the chamber 2 was replaced with nitrogen gas. Subsequently, the test specimen was increased in temperature to a heating temperature of 900° C., and nitrogen gas was blown to the test specimen at a flow rate of 130 L/min for 3 minutes while the heating temperature was being retained. Subsequently, the power supply to the induction heating coil 12 was ceased, and the test specimen was rapidly cooled with nitrogen gas at a flow rate of 130 L/min. By performing the above-described operations, a titanium material with a hardened nitrided layer as Example 1 was obtained. FIG. 3 shows the thermal history of the aforementioned test specimen.

Example 2

In Example 2, the surface nitriding treatment of a pure titanium material was performed without performing the FPP treatment in the same manner as in above-described Example 1. Example 2 was different from Example 1 only in the flow rate of nitrogen gas; the flow rate of nitrogen gas was set to be 70 L/min.

Example 3

In Example 3, the surface nitriding treatment of a pure titanium material was performed without performing the FPP treatment in the same manner as in above-described Example 1 and Example 2. Example 3 was different from Example 1 only in the flow rate of nitrogen gas; the flow rate of nitrogen gas was set to be 10 L/min.

Example 4 to Example 6

In each of Example 4 to Example 6, the surface nitriding treatment of a titanium material made of a titanium alloy was performed without performing the FPP treatment in the same manner as in above-described Example 1 to Example 3. Example 4 to Example 6 were different from Example 1 to Example 3 only in the test specimens. Specifically, in each of Example 4 to Example 6, a round rod of Ti-6Al-4V was used as the test specimen. In addition, Example 4 adopted a flow rate of nitrogen gas of 130 L/min in the same manner as in Example 1; Example 5 adopted a flow rate of nitrogen gas of 70 L/min in the same manner as in Example 2; and Example 6 adopted a flow rate of nitrogen gas of 10 L/min in the same manner as in Example 3.

Example 7

In Example 7, the surface nitriding treatment of a titanium alloy material was performed without performing the FPP treatment in the same manner as in Example 4. Example 7 was different from Example 4 only in the heating time of the titanium alloy material involving the blowing of nitrogen gas, and adopted 1.5 minutes as the heating time.

Example 8

Example 8 was different from above-described Example 1 to Example 7, in that the surface nitriding treatment of a titanium material involving the FPP treatment to blast the blasting particles to the surface of the test specimen was performed. Example 8 was different from Example 4 only in that the nitrogen gas used in the surface nitriding treatment of the titanium material contained blasting particles. Specifically, in Example 8 as the blasting material, titanium particles having an average particle size of 45 μm or less were used. In the FPP treatment in Example 8, the FPP treatment particle supply rate was 0.2 g/s, the blasting distance was 100 mm, the blast pressure was 0.5 MPa, the flow rate of nitrogen gas was 130 L/min, and the blasting time was 3 minutes. It is to be noted that after the FPP treatment, in the same manner as in Example 1 to Example 7, the power supply to the induction heating coil 12 was ceased, and the test specimen was rapidly cooled with nitrogen gas at a flow rate of 130 L/min.

Example 9

In Example 9, the surface nitriding treatment of a titanium alloy material involving the FPP treatment was performed in the same manner as in Example 8. In Example 9, the FPP treatment was performed only in part of the whole of the treatment steps of the heat treatment of the titanium alloy material involving the blowing of nitrogen gas. Specifically, in Example 9, the heating (AIH-FPP treatment) of the titanium alloy material was performed while the nitrogen gas containing the blasting material was being blown to the titanium alloy material for 1 minute, under the same FPP treatment conditions as in Example 8, and then the heating (heating retention) of the titanium alloy material was performed while the nitrogen gas containing no blasting material was being successively blown to the titanium alloy material. Subsequently, the power supply to the induction heating coil 12 was ceased, and the titanium alloy material was rapidly cooled with nitrogen gas at a flow rate of 130 L/min. FIG. 4 shows the thermal history of Example 9.

COMPARATIVE EXAMPLES

Next, Comparative Example 1 and Comparative Example 2 of the surface nitriding treatment method of a titanium material according to the present invention are described.

Comparative Example 1

In Comparative Example 1, the heat treatment of a pure titanium material involving the blowing of nitrogen gas was performed without performing the FPP treatment in the same manner as in above-described Example 1. Comparative Example 1 was different from Example 1 only in the heating temperature of the test specimen, and adopted 600° C. as the heating temperature.

Comparative Example 2

In Comparative Example 2, the heat treatment of a titanium alloy material involving the blowing of nitrogen gas was performed without performing the FPP treatment in the same manner as in above-described Example 4. Comparative Example 2 was different from Example 4 only in the heating time of the test specimen. Specifically, in Comparative Example 2, the test specimen was heated to 900° C. while nitrogen gas was being blown to the test specimen, and then immediately cooled. The heating retention time at 900° C. was set to be 0 minute.

Table 1 collectively shows the experimental conditions of above-described Example 1 to Example 9 and Comparative Example 1 and Comparative Example 2.

TABLE 1

| | Base material | Treatment temperature | FPP treatment time | Heating retention time | $N_2$ gas blow flow rate | Blasting particle | Particle supply rate | Particle blasting pressure |
|---|---|---|---|---|---|---|---|---|
| Example 1 | Pure Ti | 900° C. | 0 | 3 min | 130 L/min | — | — | — |
| Example 2 | | | | | 70 L/min | | | |
| Example 3 | | | | | 10 L/min | | | |
| Example 4 | Ti—6Al—4V | | | | 130 L/min | | | |
| Example 5 | | | | | 70 L/min | | | |
| Example 6 | | | | | 10 L/min | | | |
| Example 7 | | | | 1.5 min | 130 L/min | | | |
| Example 8 | | | 3 min | 0 | 130 L/min | Ti particle | 0.2 g/s | 0.5 MPa |
| Example 9 | | | 1 min | 2 min | | | | |
| Comparative Example 1 | Pure Ti | 600° C. | 0 | 3 min | 130 L/min | — | — | — |
| Comparative Example 2 | Ti—6Al—4V | 900° C. | 0 | 0 | 130 L/min | — | — | — |

(Evaluations)

For each of above-described Example 1 to Example 9, and Comparative Example 1 and Comparative Example 2, a macroscopic observation, a mass measurement before and after the treatment, an XRD (X-Ray Diffractometer: XRD) analysis and a Vickers hardness measurement were performed, and thus evaluations were performed.

(1) On Example 1 to Example 3

At the beginning, Example 1 to Example 3 are described in which pure titanium materials were used as the test specimens, the FPPP treatment was not performed, and only the condition of the flow rate of nitrogen gas was varied. In each of Example 1 to Example 3, a treatment was performed at 900° C. for 3 minutes while nitrogen gas was being blown to the surface of a pure titanium material at a flow rate of 10 L/min or more. All the surfaces of the pure titanium materials of Example 1, Example 2 and Example 3 exhibited ocher colors observed by surface nitriding, the flow rates of nitrogen gas adopted in Example 1, Example 2 and Example 3 being 130 L/min, 70 L/min and 10 L/min, respectively. The ocher colors of the surfaces showed a tendency to become deeper with the increase of the flow rate of nitrogen gas.

FIG. 5 shows the mass variations from before to after the treatment in Example 1 to Example 3. As shown in FIG. 5, in any one of Example 1 to Example 3, the mass was increased from before to after the treatment, and the increase of the mass showed a tendency to increase with the increase of the flow rate of nitrogen gas. From these macroscopic observations and mass variations, the mass is interpreted to increase due to the chemical reaction between nitrogen and titanium and the diffusion of nitrogen into the inside of the base material of the titanium material. Thus, the increase of the flow rate of nitrogen gas can be understood to promote the nitriding of the titanium material.

Next, the XRD analysis results of Example 1 to Example 3 are described with reference to FIG. 6. FIG. 6 shows the XRD analysis results of Example 1 to Example 3, and an untreated material. As shown in FIG. 6, it was able to be verified that on the surfaces of the test specimens of Example 1 to Example 3 in each of which the FPP treatment was not performed, the treatment temperature was 900° C., and the flow rate of nitrogen gas was 10 L/min to 130 L/min, the peaks of TiN, unidentifiable in the untreated material, were found, and the nitrided layers formed of TiN were present on the surfaces of the test specimens. The peaks of TiN appeared more remarkably with the increase of the flow rate of nitrogen gas, and accordingly, as can be seen from the XRD results, the nitriding of the titanium material is promoted with the increase of the flow rate of nitrogen gas.

Next, the evaluations based on the Vickers hardness test of the test specimens of Example 1 to Example 3 are described with reference to FIG. 7. FIG. 7 shows the Vickers hardness distributions of the test specimens of Example 1 to Example 3, in the direction from the surface toward the inside on a longitudinal cross section. As shown in FIG. 7, the test specimens of Example 1 to Example 3, in which the treatment temperature was 900° C. and the flow rate of nitrogen gas was 10 L/min or more, all showed maximum hardness values within a range of 30 μm from the surface, and it is found that hardened nitrided layers were formed on the surfaces of the test specimens. In Example 1 in which the flow rate of nitrogen gas was 130 L/min, the maximum hardness exceeded 480 HV (25 g), and the depth of the hardened nitrided layer was 120 μm. In Example 2 in which the flow rate of nitrogen gas was 70 L/min, the maximum hardness exceeded 360 HV (25 g), and the depth of the hardened nitrided layer was 100 μm. In Example 3 in which the flow rate of nitrogen gas was 10 L/min, the maximum hardness was 290 HV (25 g), and the depth of the hardened nitrided layer was 90 μm. As can be seen from the figure showing the Vickers hardness values, at one and the same temperature, the larger the flow rate of nitrogen gas, the harder the formed hardened nitrided layer is and the thicker the formed hardened nitrided layer is.

(2) On Example 4 to Example 6

Next, Example 4 to Example 6 are described in which titanium alloy materials were used as the test specimens, the FPP treatment was not performed, and only the condition of the flow rate of nitrogen gas was varied. In each of Example 4 to Example 6, the treatment was performed at 900° C. for 3 minutes while nitrogen gas was blown at a flow rate of 10 L/min or more to the surface of the titanium alloy material. The evaluations based on the Vickers hardness test of the test specimens of Example 4 to Example 6 are described with reference to FIG. 8. FIG. 8 shows the Vickers hardness distributions of the test specimens of Example 4 to Example 6, in the direction from the surface toward the inside on a longitudinal cross section. As shown in FIG. 8, the test specimens of Example 4 to Example 6, in which the treatment temperature was 900° C. and the flow rate of nitrogen gas was 10 L/min or more, all showed maximum hardness values on the outermost surfaces, and it is found that hardened nitrided layers were formed on the surfaces of the test specimens. In Example 4 in which the flow rate of nitrogen gas was 130 L/min, the maximum hardness exceeded 560 HV (25 g), and the depth of the hardened nitrided layer was 120 μm. In Example 5 in which the flow rate of nitrogen gas was 70 L/min, the maximum hardness exceeded 510 HV (25 g), and the depth of the hardened nitrided layer was 80 μm. In Example 6 in which the flow rate of nitrogen gas was 10 L/min, the maximum hardness was 480 HV (25 g), and the depth of the hardened nitrided layer was 50 μm. As can be seen from the figure showing the Vickers hardness values, also in the case where the titanium alloy materials were treated, at one and the same temperature, the larger the flow rate of nitrogen gas, the harder the formed hardened nitrided layer is and the thicker the formed hardened nitrided layer is.

(3) On Comparative Example 1

In Comparative Example 1, as the flow rate of nitrogen gas, adopted was the flow rate of 130 L/min resulting in the formation of the hardened nitrided layer having the highest thickness and the thickest thickness, as can be seen from the results of Example 1 to Example 3. And, the treatment temperature was set at 600° C. In this case, as shown in the XRD analysis results of Comparative Example 1 and the untreated material in FIG. 9, no peak of TiN was able to be identified on the surface of the test specimen as it was the case for the untreated material. Consequently, it was able to be verified that when the treatment temperature was 600° C., a nitrided layer made of TiN was unable to be formed on the surface of the pure titanium material.

(4) On Example 4, Example 7 and Comparative Example 2

Next, Example 4, Example 7 and Comparative Example 2 are described in which titanium alloy materials were used as test specimens, the FPP treatment was not performed, and only the time of the heat treatment involving a flow rate of nitrogen gas of 130 L/min was varied. In any of Example 4, Example 7 and Comparative Example 2, the heat treatment was performed at 900° C. while nitrogen gas was being blown at a flow rate of 130 L/min to the surface of the titanium alloy material. In Example 4, the treatment time (heating retention time) was set to be 3 minutes, and in Example 7, the treatment time (heating retention time) was set to be 1.5 minutes. In Comparative Example 2, immediately after the temperature was increased to 900° C., the test specimen was cooled. The evaluations based on the Vickers hardness test of the test specimens of Example 4, Example 7 and Comparative Example 2 are described with reference to FIG. 10. FIG. 10 shows the Vickers hardness distributions of the test specimens of Example 4, Example 7 and Comparative Example 2, in the direction from the surface toward the inside on a longitudinal cross section. As shown in FIG. 10, it is found that with the increase of the heat treatment time, the hardness of the outermost surface of the formed hardened nitrided layer was increased. It is also found that when the heat treatment time was maintained for at least 1.5 minutes or more, the hardness of the outermost surface was able to be 420 HV (25 g) or more, and the thickness of the hardened nitrided layer was able to be 50 μm or more.

(5) On Example 4, Example 8 and Example 9

Next, Example 4, Example 8 and Example 9 are described in each of which a titanium alloy material was used as the test specimen, and only the treatment time of the FPP treatment was varied when the heat treatment involving the blowing of nitrogen gas at a flow rate of 130 L/min was performed. In any of Example 4, Example 8 and Example 9, the heat treatment was performed at 900° C. while nitrogen gas was being blown to the surface of the titanium alloy material at a flow rate of 130 L/min. In Example 4, the time of the FPP treatment was set to be 0 minute, and the heat treatment time (heating retention time) involving the blowing of the nitrogen gas containing no blasting material was set to be 3 minutes. In Example 8, the heat treatment time involving the blowing of the nitrogen gas containing a blasting material was set to be 3 minutes, and no heat treatment involving the nitrogen gas containing no blasting material was performed. In Example 9, the heat treatment time involving the blowing of the nitrogen gas containing a blasting material was set to be 1 minute, and the heat treatment time (heating retention time) involving the blowing of the nitrogen gas containing no blasting material was set to be 2 minutes. In any one of Examples 4, 8 and 9, the heating time of the whole of the heat treatment steps was set to be 3 minutes in common.

The surface of the test specimen of Example 4 in which the FPP treatment time was set to be 0 minute exhibited ocher color observed by surface nitriding. Example 9 in which the FPP treatment time was set to be 1 minute and the heating retention time was set to be 2 minutes exhibited ocher color observed by surface nitriding, similarly to Example 4, but the density of the ocher color was lower. In contrast to this, in Example 8 in which the FPP treatment time was set to be 3 minutes, and the heating retention time was set to be 0 minute, almost no ocher color was able to be observed on the surface of the test specimen.

On the other hand, FIG. 11 shows the Vickers hardness distributions of the test specimens of Example 4, Example 8 and Example 9, in the direction from the surface toward the inside on a longitudinal cross section. As shown in FIG. 11, irrespective of the application or nonapplication of the FPP treatment and the FPP treatment time, there were no large differences in the hardness values and the thickness values of the formed hardened nitrided layers. From these evaluation results, in consideration of the fact that the ocher color observed in the surface nitriding is due to the effect of the TiN layer, it can be determined that by allowing the blasting material to be contained in the nitrogen gas to be blown to the surface of the titanium material, and by allowing the blasting material to collide with the surface of the titanium material, the formation of the nitrogen diffusion layer is promoted while the formation of the TiN layer to be a factor to decrease the fatigue strength is being suppressed, and the formation of a hardened nitrided layer provided with a predetermined strength can be performed.

INDUSTRIAL APPLICABILITY

The surface nitriding treatment method of a titanium material according to the present invention can form a hardened nitrided layer excellent in abrasion resistance in a short time, on the surface of a titanium material excellent in specific strength, corrosion resistance and biocompatibility. Accordingly, the present invention is effective in that the present invention can efficiently improve the abrasion resistance of a titanium material excellent in specific strength.

REFERENCE SIGNS LIST

W titanium material
C control device
1 surface nitriding treatment apparatus
2 chamber
3 nitrogen gas or nitrogen gas containing blasting material
5 high-frequency applying device
6 vacuum gauge
7 vacuum pump
8 exhaust valve
11 support
12 induction heating coil (heating unit)
13 exhaust path
13A atmosphere open valve
14 oxygen concentration meter
15 temperature sensor
20 discharge unit
21 discharge nozzle
22 gas regulation valve
23 nitrogen gas supply unit
24 gas supply path
25 blasting material supply path
26 part feeder
27 blasting material regulation valve

The invention claimed is:

1. A surface nitriding treatment method of a titanium material, the method comprising:

forming a hardened nitrided layer on the surface of the titanium material by blowing nitrogen gas at a flow rate of 70 L/min or more to the surface of the titanium material while the titanium material is being heated to 800° C. to 1000° C. in an inert gas atmosphere.

2. The surface nitriding treatment method of a titanium material according to claim 1, wherein the titanium material is pure titanium or a titanium alloy.

3. The surface nitriding treatment method of a titanium material according to claim 1, wherein the titanium material is heated by a high-frequency induction heating method.

4. The surface nitriding treatment method of a titanium material according to claim 1, wherein the heating time of the titanium material involving the blowing of nitrogen gas is 1 minute to 60 minutes.

5. The surface nitriding treatment method of a titanium material according to claim 1, wherein the nitrogen gas contains a blasting material, the blasting material is jetted to the surface of the titanium material being heated, and thus the titanium material is subjected to a surface treatment.

6. The surface nitriding treatment method of a titanium material according to claim 5, wherein the blasting material is a titanium particle.

7. A surface nitriding treatment method of a titanium material, the method comprising:

forming a hardened nitrided layer on the surface of the titanium material by blowing nitrogen gas at a flow rate of 10 L/min or more to the surface of the titanium material while the titanium material is being heated to 800° C. to 1000° C. in an inert gas atmosphere;

wherein the nitrogen gas contains a blasting material, the blasting material is jetted to the surface of the titanium material being heated, and thus the titanium material is subjected to a surface treatment.

8. The surface nitriding treatment method of a titanium material according to claim 7, wherein the blowing flow rate of the nitrogen gas is 70 L/min or more.

9. The surface nitriding treatment method of a titanium material according to claim 7, wherein the titanium material is pure titanium or a titanium alloy.

10. The surface nitriding treatment method of a titanium material according to claim 7, wherein the titanium material is heated by a high-frequency induction heating method.

11. The surface nitriding treatment method of a titanium material according to claim 7, wherein the heating time of the titanium material involving the blowing of nitrogen gas is 1 minute to 60 minutes.

12. The surface nitriding treatment method of a titanium material according to claim 7, wherein the blasting material is a titanium particle.

* * * * *